US008118336B2

(12) United States Patent
Fritz

(10) Patent No.: US 8,118,336 B2
(45) Date of Patent: Feb. 21, 2012

(54) DOOR STOP

(76) Inventor: Daniel W. Fritz, Clifton, VA (US)

( * ) Notice: Subject to any disclaimer, the term of this patent is extended or adjusted under 35 U.S.C. 154(b) by 189 days.

(21) Appl. No.: 12/480,575

(22) Filed: Jun. 8, 2009

(65) Prior Publication Data

US 2009/0302622 A1 Dec. 10, 2009

Related U.S. Application Data

(60) Provisional application No. 61/059,779, filed on Jun. 8, 2008.

(51) Int. Cl.
*E05C 17/54* (2006.01)
*E05C 17/00* (2006.01)

(52) U.S. Cl. ..... 292/343; 292/DIG. 15

(58) Field of Classification Search ..... 292/343, 292/DIG. 15
See application file for complete search history.

(56) References Cited

U.S. PATENT DOCUMENTS

| | | | | | |
|---|---|---|---|---|---|
| 281,504 | A | * | 7/1883 | Hazen et al. | 292/343 |
| 628,366 | A | * | 7/1899 | Sponcel | 292/343 |
| 652,659 | A | * | 6/1900 | Blackwell | 292/343 |
| 656,116 | A | * | 8/1900 | Hoffman | 292/343 |
| 1,599,595 | A | * | 9/1926 | Sponsel | 292/343 |
| 1,833,773 | A | * | 11/1931 | Brooks | 292/343 |
| 1,851,101 | A | * | 3/1932 | Johnson | 292/343 |
| 1,879,664 | A | * | 9/1932 | Eaton | 292/343 |
| 2,487,427 | A | * | 11/1949 | Hallard et al. | 292/343 |
| 3,054,632 | A | * | 9/1962 | Welch | 292/288 |
| 4,044,424 | A | * | 8/1977 | Sasgen | 16/85 |
| 4,591,148 | A | * | 5/1986 | Slater | 482/140 |
| 5,331,719 | A | * | 7/1994 | Hum et al. | 16/85 |
| 5,368,349 | A | * | 11/1994 | Hebert et al. | 292/343 |
| 5,468,032 | A | * | 11/1995 | Hebert et al. | 292/343 |
| 5,601,320 | A | * | 2/1997 | Miller | 292/343 |
| 5,697,656 | A | * | 12/1997 | Hebert et al. | 292/343 |

* cited by examiner

*Primary Examiner* — Carlos Lugo
(74) *Attorney, Agent, or Firm* — Evans & Molinelli PLLC; Eugene Molinelli

(57) ABSTRACT

A doorstop includes a flange connected to a floor contacting portion. The flange is deflectable under transverse pressure. During operation, a door-engaging end portion of the flange contacts a vertical face of a door. Upon deflection, the end portion drops below the vertical face to allow the door to close. In some embodiments, a doorstop includes a spring member and a flange. The spring member includes an arc-shaped portion having a rest curvature and a floor contacting end portion. The arc-shaped portion is deflectable to an arc with less curvature under transverse pressure and returns to the rest curvature upon removal of the transverse pressure. The flange includes a door-engaging end portion and a different attached portion. The attached portion is attached to the arc-shaped portion of the spring member such that the flange is substantively tangent to the arc-shaped portion of the spring member along the attached portion.

12 Claims, 4 Drawing Sheets

DOOR STOP

CROSS-REFERENCE TO RELATED APPLICATIONS

This application claims benefit of Provisional Appln. 61/059,779, filed Jun. 8, 2008 under 35 U.S.C. §119(e).

BACKGROUND OF THE INVENTION

1. Field of the Invention

The present invention relates to door stops, and in particular to a door stop with a extended flange deflectably mounted to engage a door to be stopped.

2. Description of the Related Art

A number of door stops have been described in the art, each with some advantage in terms of manufacturing or footprint or portability or ease of use without requiring a user to bend down and manually move a device in place every time a door is opened. For example, spring action door stops described in U.S. Pat. No. 4,044,424 to A. Sasgen (hereinafter Sasgen) and U.S. Pat. No. 5,331,719 to T. Hum (hereinafter Hum) work by applying pressure on the underside of a door when the door is positioned over the device. While suitable for many purposes, these doorstops suffer various deficiencies. For example, Sasgen involves rather precise knowledge of the distance between the bottom of the door and the floor, and different devices are suggested for different distances. In Hum, a high friction material is required on both an upper surface to engage the underside of a door and on a lower surface to prevent slippage on the floor. Since doors and floor materials can differ widely, from metal to wood to carpet to plastic, for example, different high friction material combinations are needed to engage both boor and floor. Furthermore, in Hum a user must depress the doorstop, such as with the user's foot, to position the door over the doorstop. Such maneuvers are sometimes difficult and awkward.

SUMMARY OF THE INVENTION

In one embodiment, a doorstop for holding a door in an open position includes a flange connected to a floor contacting portion. The flange is deflectable under transverse pressure. During operation, a door-engaging end portion of the flange contacts a vertical face of a door to keep the door in an open position. Upon deflection, the door-engaging end portion drops below the vertical face of the door to allow the door to close.

In another embodiment, a doorstop for holding a door in an open position includes a spring member and a flange. The spring member includes an arc-shaped portion having a rest curvature and a floor contacting end portion. The arc-shaped portion is deflectable to an arc with less curvature under transverse pressure and returns to the rest curvature upon removal of the transverse pressure. The flange includes a door-engaging end portion and a different attached portion that is attached to the arc-shaped portion of the spring member. The flange is substantively tangent to the arc-shaped portion of the spring member along the attached portion. The door-engaging end portion of the flange contacts a vertical face of a door to keep the door in an open position.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

An apparatus is described for operating as a doorstop. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

Figure 1:
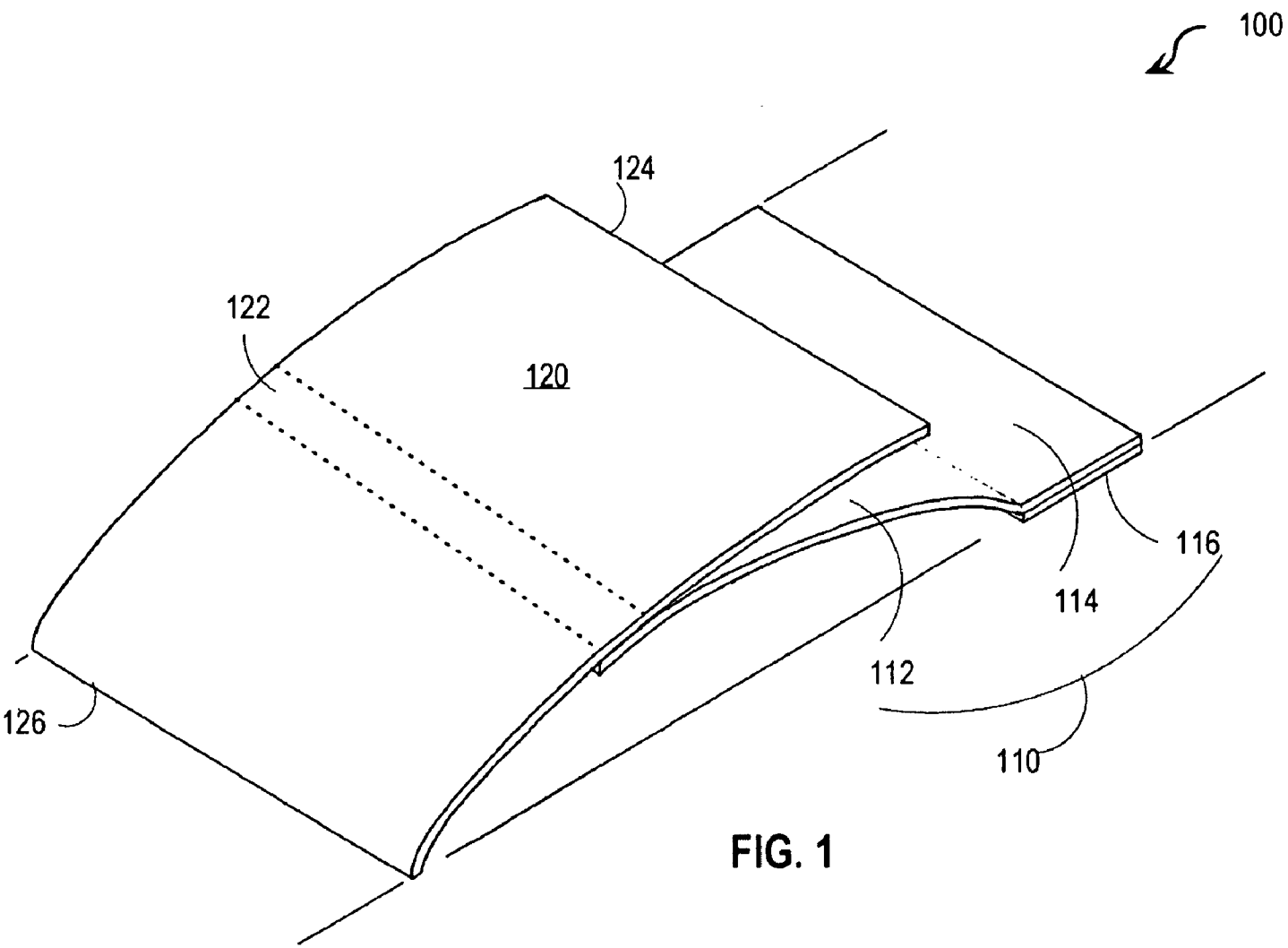
FIG. 1 is a perspective drawing that illustrates a doorstop, according to an embodiment.

FIG. 1 is a perspective drawing that illustrates a doorstop 100, according to an embodiment. The doorstop 100 is depicted deployed on a horizontal floor indicated in FIG. 1 by diagonal lines; however, the floor is not part of the doorstop 100.

The doorstop includes a spring member 110 and a flange 120. The spring member 110 includes an arc-shaped portion 112 having a rest curvature and a floor contacting end portion 114 that is flat. The flange 120 includes a door-engaging end portion adjacent to door-engaging end 124 and a different attached portion 122 that is attached to the arc-shaped portion 112 of the spring member. The flange 120 is substantively tangent to the arc-shaped portion 112 along the attached portion 122. In this embodiment, the flange 120 includes a floor contacting end portion adjacent to floor contacting end 126 opposite the door-engaging end 124. In the illustrated embodiment, the flange 120 is also arc-shaped in the floor contacting end portion. An advantage of this embodiment is that the footprint of the door stop 100 is reduced compared to a flange that is straight from the attached portion to the floor contacting end 126. Another advantage is that the flange 120 with an arc-shaped floor contacting end portion contributes to returning the door stop to a rest configuration, described below.

Any method may be used to attach the flange 120 to the spring member 110, including the use of fasteners, glue, solder, welding, and manufacture as an integrate unit of the same material. In an example embodiment, flange and spring member are attached with three spot welds.

In some embodiments, the flange is connected to a floor contacting portion as an integral unit. In some embodiments the arc of the spring member is also tangent to the floor contacting portion.

The arc-shaped portion 112 is deflectable to an arc with less curvature under transverse pressure, which is downward onto an upper surface of the arc-shaped portion. The arc-shaped portion is made of sufficiently resilient material (such as spring metal) so that it returns to its shape with the rest curvature upon removal of the transverse pressure. The doorstop 100 is depicted in FIG. 1 in its rest configuration with the arc-shaped portion having its rest curvature. The rest curvature need not be constant over the length of the arc-shaped portion and in the illustrated embodiments varies with position along the arc-shaped portion. In an example embodiment, flange 120 and spring member 110 are both made of zinc sheet metal.

The flange 120 and arc-shaped portion 112 of the spring member 110 deflect floorward, due to transverse pressure applied to the arc-shaped portion 112 through the flange 120 as a door passes over the doorstop 100, to allow the door to pass. After the door passes, the arc-shaped portion 112 returns to the rest curvature and the flange 120 returns to the rest configuration. The door-engaging end 124 the flange 120 contacts a vertical face of a door to keep the door in an open position.

In this embodiment, the floor contacting end portion 114 of the spring member is coated on its lower surface with a high friction material 116 that inhibits or prevents slippage on a floor where the doorstop 100 is deployed. Any high friction material suitable for preventing slippage on a particular range of floor coverings may be used. For example, in some embodiments, the material 116 is an assembly of tiny hooks that engage fibers in a carpet, such as the hook assembly of hooks and loops materials available commercially from VELCRO™ (Velcro USA Inc., Manchester, N.H.). In some embodiments the high friction material is rubber, such as used in conventional triangular-shaped doorstops to prevent slippage on wood floors.

Figure 2:
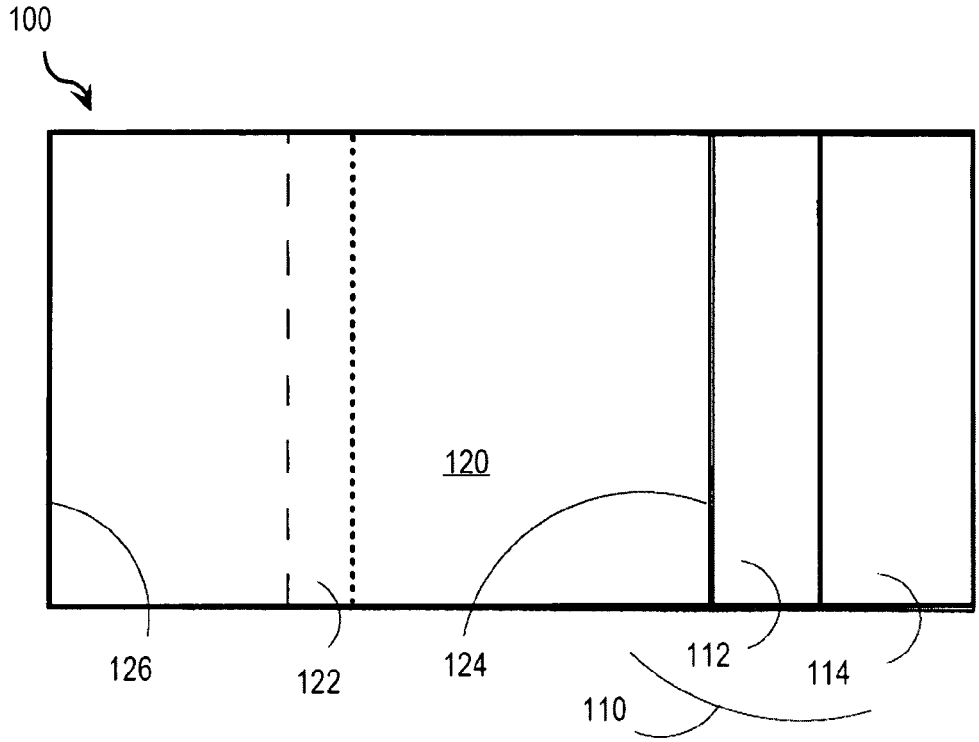
FIG. 2 is a plan view that illustrates the doorstop, according to the same embodiment.

FIG. 2 is a plan view that illustrates the doorstop 100, according to the same embodiment. The flange is visible from floor contacting end 126 to door engaging end 124. The attached portion 122 is marked. The left edge of the attached portion 122 represents the leftmost extent of the spring member 110 hidden beneath the flange 120. Some of the arc-shaped portion 112 of the spring member 110 is visible to the right of the door engaging end 124. The floor contacting portion 114 of the spring member 110 is also visible at the farthest right. The high friction material is not visible as it lies on the under surface of the floor contacting portion 114.

Although the flange and spring member have a rectangular shape in the plan view of the illustrated embodiment, in other embodiments, other shapes are used, including hourglass shapes that are narrow between the ends 124 and 126 of flange 120, and trapezoidal shapes with one of the door engaging end 124 and the floor contacting end 126 longer than the other but parallel to each other. In some embodiments the door engaging end 124 is not parallel to the floor contacting end 126. The length, width and shape of the spring member 110 and flange 120 can be determined by one of ordinary skill in the art by routine experimentation. In a preferred embodiment, the plan views are rectangular, as depicted, with dimensions as follows: width is 9 cm; overall length is 16¾ cm; length of floor contact portion 114 is 3 cm; length of arc-shaped portion 112 is 10 cm; length of flange 120 is 13 cm; distance from attached portion 122 to door-engaging end 124 is 6½ cm.

Figure 3:
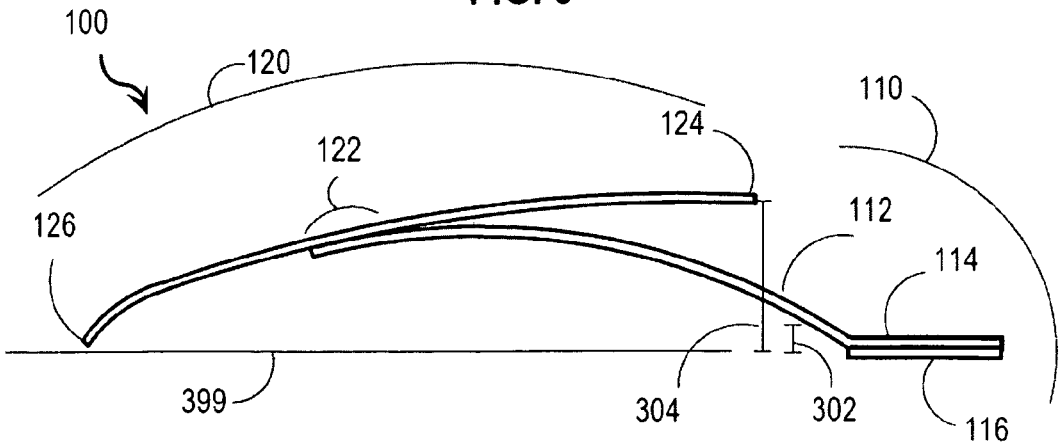
FIG. 3 is an elevation view that illustrates the doorstop, according to the same embodiment.

FIG. 3 is an elevation view that illustrates the doorstop 100, according to the same embodiment. Doorstop 100 includes: spring member 110 with arc-shaped portion 112, floor contacting portion 114 and high friction material 116; and flange 120 with door engaging end 124, floor contacting end 126 and attached portion 122. As can be seen in FIG. 3, the flange 120 is substantively tangent to the arc-shaped portion 112 at the attached portion 122. In the illustrated embodiment, the door-engaging end 124 is farther than the attached portion 122 from a plane defined by the floor contacting end portion 114 of the spring member 110

Also depicted in FIG. 3 is floor elevation 399 when the doorstop 100 is deployed for operation, but the floor elevation is not part of the doorstop 100.

Also depicted in FIG. 3 is the operational range of the doorstop 100 for holding a door in an open position. The doorstop 100 operates to hold a door open for any door that has a bottom height between height 302 above the floor elevation 399 and a height 304 above the floor elevation 399. For a door with a bottom height less than height 302, the arc-shaped portion is deflected so far as to loss its resilience to return to its original rest curvature. The height 302 can be determined by one of ordinary skill in the art through routine experimentation. For a door with a bottom height greater than height 304, the door engaging end 124 of flange 120 will fail to engage the door, and the door will be free to return to its closed position.

A person of ordinary skill in the art can chose designs so that height 302 and height 304 cover a sufficient range of heights to provide door stopping functionality for a commercially useful range of door bottom heights. For example, rest curvature for arc-shaped portion 112 at the attached portion 122 and length of flange 120 from attached portion 122 to door engaging end 124 can be selected to provide for a large height 304. In a preferred embodiment, the height 302 is about one centimeter (e.g., about ½ inch) and the height 304 is about 2½ cm (about 1¼ inch).

An advantage of this embodiment over Sasgen is that the same device works for a wider range of door bottom heights.

Figure 4:
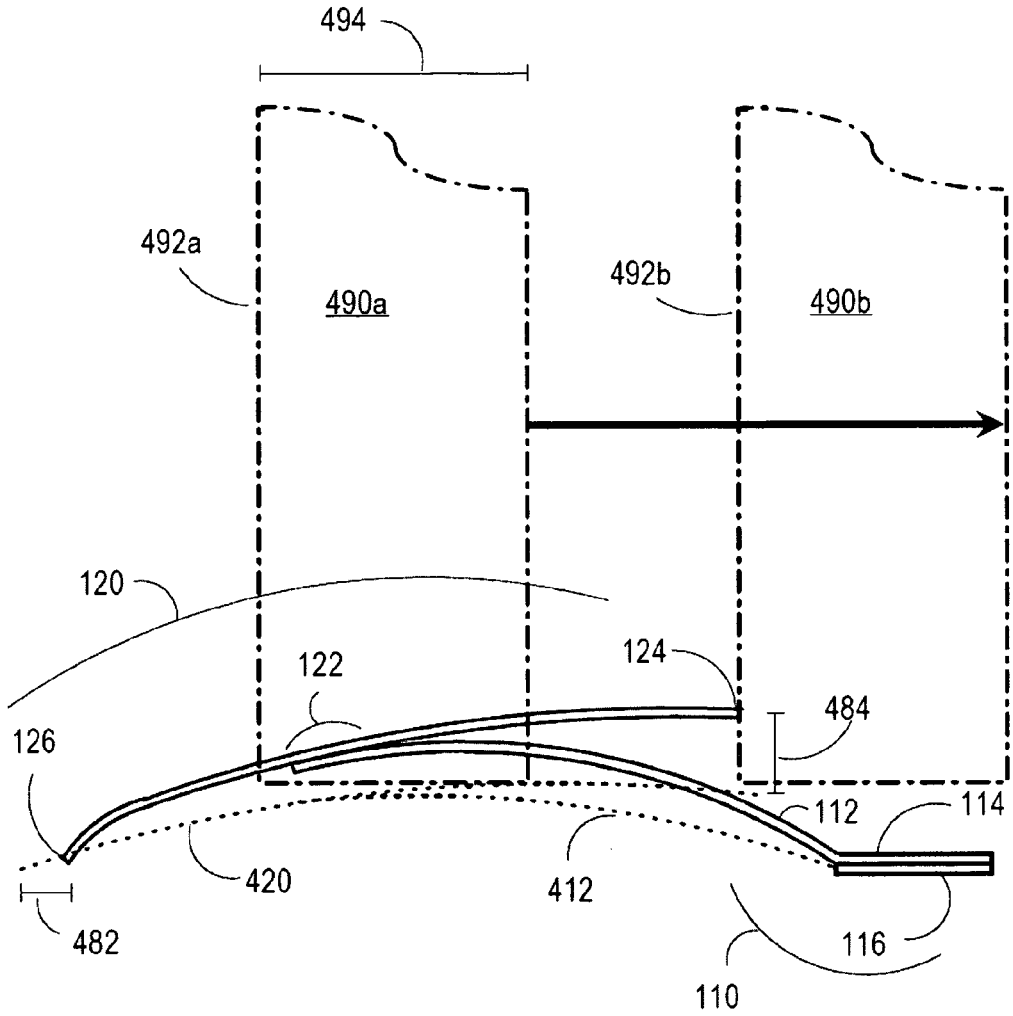
FIG. 4 is a diagram that illustrates the operation of the doorstop as a door passes over, according to the same embodiment.

FIG. 4 is a diagram that illustrates the operation of the doorstop 100 as a door passes over, according to the same embodiment. As shown also in FIG. 3, in a rest configuration, without transverse pressure, doorstop 100 includes: spring member 110 with arc-shaped portion 112, floor contacting portion 114 and high friction material 116; and flange 120 with door engaging end 124, floor contacting end 126 and attached portion 122.

When a door moves across the doorstop 100 from left to right, the doorstop deflects to allow the door to pass. This configuration is depicted in FIG. 4 by door **490*a* in a first position. The door has width 494 and a vertical face 492*a*. The door 490*a* applies transverse pressure to flange 120 that transfers the pressure to the arc-shaped portion 112 of spring member 110 through the attached portion 122. In response, the arc-shaped portion 112 deflects to position indicated by dotted line 412 and the flange deflects to position indicated by the dotted line 420. The range of movement of the door engaging end from the rest configuration to the deflected configuration is indicated by distance 484. In a preferred embodiment, the flange is made of material that is slick enough to not significantly oppose the sliding of the door over the flange 120**.

The floor contacting portion 114 stays in position because of the high friction material 116 in contact with the floor. The floor contacting end 126 of flange 120 moves along the floor to accommodate the deflection. This range of along floor motion is indicated by the distance 482. In other embodiments, the high friction material is on the floor contacting end 126 of flange 120 and not on the floor contacting end portion 114 of the spring member 110, so that the latter end slides when the doorstop is compressed by the door passing over. Thus, it is desirable that only one of the floor contacting end 126 and the floor contacting portion 114 of the spring member is coated with high friction material 116.

Because the door slides easily over the illustrated embodiment and automatically compresses the doorstop as the door is opened, a user does not have to depress the doorstop by hand or foot, as is often necessary for the doorstop of Hum.

When the door passes past the door engaging end, as indicated by the dark horizontal arrow, this configuration is depicted in FIG. 4 by door 490*b* in a second position. The door no longer applies a transverse pressure to flange 120 and the spring member and flange return to their rest configuration. The door engaging end 124 prevents the door 490*b* in the second position from returning to the left and closing. Thus the store stays in the open position.

These embodiments enjoy advantages over prior art doorstops. For example, an advantage of several embodiments over Sasgen is that a single embodiment works over a larger range of door bottom heights. An advantage of several embodiments over Hum is that a user need not compress the doorstop with the user's foot as the door is positioned over the doorstop, as stated by Hum. The door automatically compresses the doorstop as the door is opened.

Figure 5:
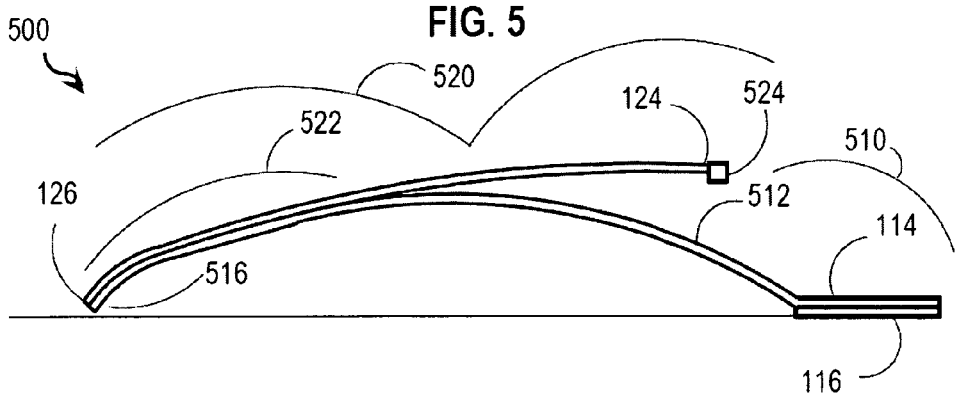
FIG. 5 is an elevation view that illustrates a doorstop, according to a different embodiment.

FIG. 5 is an elevation view that illustrates a doorstop 500, according to a different embodiment. Doorstop 500 includes a spring member 510 and a flange 510. Spring member 510 includes a floor contacting end portion 114 and high-friction material 116 as in spring member 110. However, the spring member 310 includes an arc-shaped portion 512 that extends to a second floor contacting portion 516 aligned with the floor contacting end 126 of flange 520. The flange 520 includes the door engaging end 124 and the floor engaging end 126 as in flange 120. However the flange 520 includes a more extensive attached portion 522, and door protection material 524. The door protecting material 524 is any material that serves to reduce scratching on a vertical door face (e.g., face 492*b*) when in contact with the vertical door face. In some embodiments, the door protecting material is a downward curve in the end 124 to prevent presenting a sharp edge. In some embodiments, the door protecting material is a softer material than the material that makes up the rest of flange 520. The inventor has determined that with a zinc sheet metal flange, no different door protecting material 524 is needed to prevent scratches.

Figure 6:
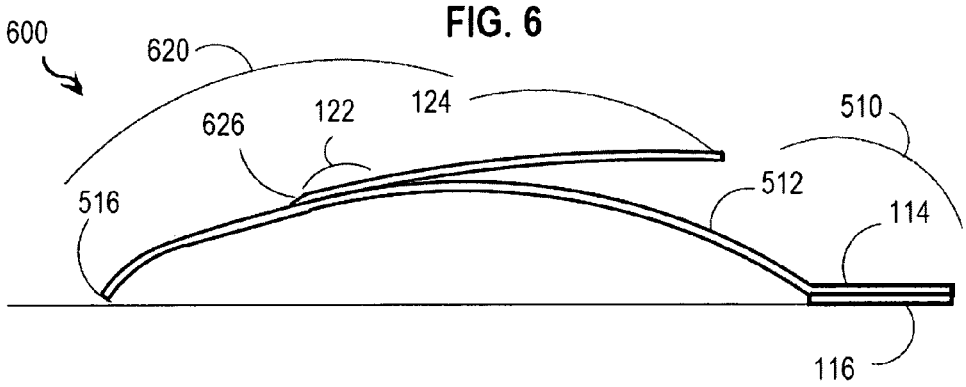
FIG. 6 is an elevation view that illustrates a doorstop, according to another different embodiment.

FIG. 6 is an elevation view that illustrates a doorstop 600, according to another different embodiment. The doorstop 600 includes spring member 510, as described above, and flange 620. Flange 620 includes the door engaging end 124 and the attached portion 122 of flange 120. However, flange 620 omits the floor contacting end 116 of flange 120; and ends at end 626 at an edge of the attached portion 122. In the illustrated embodiment, the end 626 is sloped to reduce the chances of or entirely avoid catching a door passing over.

Figure 7:
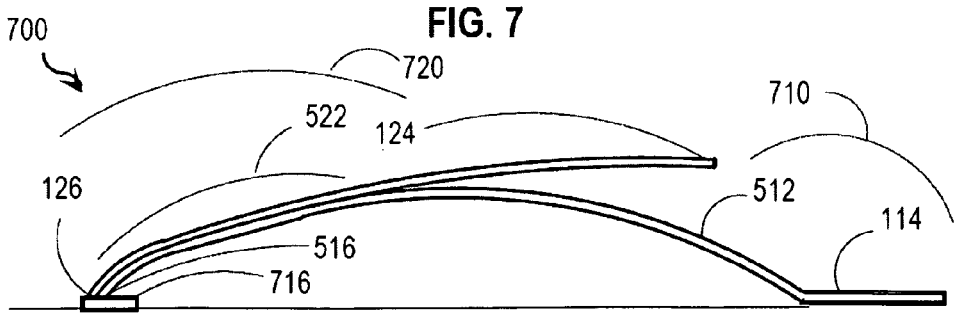
FIG. 7 is an elevation view that illustrates a doorstop, according to still another different embodiment.

FIG. 7 is an elevation view that illustrates a doorstop 700, according to still another different embodiment. The doorstop 700 includes spring member 710 and flange 720. The spring member 710 includes floor contacting portion 114 and arc-shaped portion 512, described above, but excludes high friction material 116 on the lower surface of floor contacting portion 114. Flange 720 includes the door engaging end 124 and floor contacting end 124 of flange 120, and the extended attached portion 522 of flange 520, described above. However doorstop 700 includes a high friction material 716 attached to at least one of the floor contacting end 126 of flange 720 or the floor contacting end 516 of spring member 710. In this embodiment, the floor contacting portion 114 slides along the floor when the flange 720 is pressed by a passing door bottom, while the floor contacting ends (126, 516) connected to the high friction material 716 remain in place.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. A doorstop for a door, consisting of:

a spring member including an arc-shaped portion having an initial curvature and a floor contacting end extending from a first end of the arc-shaped portion; and a flange including a smooth body that comprises a first end, an opposed door-engaging end and an attached portion between the ends, wherein the flange is positioned above the spring member and is attached to the arc-shaped portion of the spring member away from the first end of the spring member such that the flange is substantively tangent to the arc-shaped portion of the spring member along the attached portion, wherein, during movement of a door to an open position, the door engages the body so as to apply a pressure on the body that transfers pressure to the arc-shaped portion so as to compress the arc-shaped portion to a shape with less curvature than the initial curvature, allowing the door to slide against the body, and wherein, when the door is further moved to pass the door engaging end, the arc-shaped portion is decompressed to return to the initial curvature and brings the door-engaging end of the flange in a position that contacts a vertical face of the door to prevent the door to be moved toward a closed position.

2. The doorstop as recited in claim 1, wherein the door-engaging end is farther than the attached portion from a plane defined by the floor contacting end portion of the spring member.

3. The doorstop as recited in claim 1, wherein a lower surface of the floor-contacting end of the spring member is coated with a high friction material.

4. The doorstop as recited in claim 3, wherein the high friction material is a collection of very small plastic hooks that are capable of engaging fibers in a carpet.

5. The doorstop as recited in claim 3, wherein the high friction material is rubber that prevents slippage on a wood floor.

6. The doorstop as recited in claim 1, wherein the first end of the flange is a floor contacting end.

7. The doorstop as recited in claim 6, wherein a lower surface of the floor-contacting end of the flange is coated with a high friction material and the lower surface of the floor-contacting end portion of the spring member is not coated with a high friction material.

8. The doorstop as recited in claim 1, wherein the spring member includes a different second floor-contacting end opposite to the first end of the arc-shaped portion.

9. The doorstop as recited in claim 8, wherein a lower surface of only one of the floor-contacting ends of the spring member is coated with a high friction material.

10. The doorstop as recited in claim 1, wherein the door-engaging end is configured to avoid scratching a surface of a door contacted by the door-engaging end portion.

11. A doorstop for a door, consisting of:

a spring member including a first and a second opposite floor contacting ends and an arc-shaped portion having an initial curvature extending between the first and second floor contacting ends; and a flange including a smooth body that comprises a floor contacting end, an opposed door-engaging end and an attached portion between the ends, wherein the flange is positioned above the spring member and the attached portion is attached to a portion of the arc-shaped portion of the spring member, wherein, during movement of a door to an open position, the door engages the body so as to apply a pressure on the body that transfers pressure to the arc-shaped portion so as to compress the arc-shaped portion to a shape with less curvature than the initial curvature, allowing the door to slide against the body, and wherein, when the door is further moved to pass the door engaging end, the arc-shaped portion is decompressed to return to the initial curvature and brings the door-engaging end of the flange in a position that contacts a vertical face of the door to prevent the door to be moved toward a closed position.

12. The doorstop as recited in claim 11, wherein a lower surface of the first floor-contacting end of the flange and the spring member are coated with a high friction material and the lower surface of the second floor-contacting end of the spring member is not coated with a high friction material.

* * * * *